US009431199B2

(12) United States Patent
Stoller et al.

(10) Patent No.: US 9,431,199 B2
(45) Date of Patent: Aug. 30, 2016

(54) CIRCUIT BREAKER

(71) Applicant: ABB Technology AG, Zurich (CH)

(72) Inventors: Patrick Stoller, Zurich (CH); Martin Seeger, Oberentfelden (CH); Arthouros Iordanidis, Baden (CH); Benjamin Wuthrich, Zurich (CH)

(73) Assignee: ABB Technology AG, Zurich (CH)

( * ) Notice: Subject to any disclaimer, the term of this patent is extended or adjusted under 35 U.S.C. 154(b) by 28 days.

(21) Appl. No.: 14/511,870

(22) Filed: Oct. 10, 2014

(65) Prior Publication Data

US 2015/0021297 A1 Jan. 22, 2015

Related U.S. Application Data

(63) Continuation of application No. PCT/EP2013/057485, filed on Apr. 10, 2013, and a continuation of application No. PCT/EP2012/056528, filed on Apr. 11, 2012.

(51) Int. Cl.

| | |
|---|---|
| ***H01H 33/22*** | (2006.01) |
| ***H01H 33/91*** | (2006.01) |
| ***H01H 33/70*** | (2006.01) |
| *H01H 1/38* | (2006.01) |

(52) U.S. Cl.

CPC ..... *H01H 33/91* (2013.01); *H01H 33/7015* (2013.01); *H01H 33/7023* (2013.01); *H01H 1/385* (2013.01); *H01H 33/22* (2013.01)

(58) Field of Classification Search

CPC .... H01H 33/91; H01H 33/22; H01H 33/905; H01H 2033/566; H01H 2033/908

See application file for complete search history.

(56) References Cited

U.S. PATENT DOCUMENTS

| | | | | |
|---|---|---|---|---|
| 4,939,322 | A * | 7/1990 | Kashimura | H01H 33/91 218/62 |
| 4,992,634 | A * | 2/1991 | Thuries | H01H 33/903 218/149 |
| 5,723,840 | A * | 3/1998 | Bojic | H01H 33/91 218/57 |
| 7,339,132 | B2 * | 3/2008 | Urai | H01H 33/904 218/57 |

(Continued)

FOREIGN PATENT DOCUMENTS

| | | |
|---|---|---|
| EP | 2284854 A1 | 2/2011 |
| WO | 2006021108 A1 | 3/2006 |

OTHER PUBLICATIONS

C.M. Frank; "Application of High Current and Current Zero Simulations of High Voltage Circuit Breakers"; Contrib. Plasma Phys. 46, No. 10,(2006); pp. 787-797.

(Continued)

*Primary Examiner* — Truc Nguyen
(74) *Attorney, Agent, or Firm* — Whitmyer IP Group LLC

(57) ABSTRACT

A circuit breaker including two contacts, a pressurization chamber, a nozzle arrangement designed to blow an arc in a quenching region, with a narrowest passage of a pressurization chamber outflow channel to be passed by outflowing quenching gas defining a pressurization chamber outflow limiting area, a narrowest passage of a nozzle channel to be passed by outflowing quenching gas defining a nozzle outflow limiting area, the smaller area of which defining an absolute outflow limiting area, with quenching gas having a global warming potential lower than the one of $SF_6$ over an interval of 100 years; wherein a ratio of the pressurization chamber outflow limiting area to the nozzle outflow limiting area is less than 1.1:1.

30 Claims, 2 Drawing Sheets

(56) References Cited

U.S. PATENT DOCUMENTS

| | | | | |
|---|---|---|---|---|
| 7,566,842 | B2 * | 7/2009 | Hunger | H01H 33/901 218/14 |
| 7,816,618 | B2 | 10/2010 | Uchii | |
| 8,013,268 | B2 * | 9/2011 | Ozil | H01H 33/904 218/1 |
| 8,304,676 | B2 * | 11/2012 | Uchii | H01H 33/22 218/53 |
| 2001/0045410 | A1 | 11/2001 | Dufournet et al. | |

OTHER PUBLICATIONS

International Preliminary Report on Patentability Application No. PCT/EP2013/057485 Completed:Jun. 20, 2014; Mailing Date: Jun. 5, 2014 pp. 7.

International Search Report & Written Opinion Application No. PCT/EP2013/057485 Completed: Jul. 2, 2013; Mailing Date: Jul. 15, 2013 pp. 12.

F. Baberis et al; "Prove di interruzione su interruttori commerciali in gas (MT) con l'utilizzo di miscele SF6-free"; CESI Report L17918; pp. 94.

"Scientific Assessment of Ozone Depletion 1998, report No. 44 released by the Global Ozone Research and Monitoring Project", World Meteorological Organization; pp. 44.

H. Knobloch; "The Comparison of Arc-Extinguishing Capability of Sulfur Hexafluoride SF6 with Alternative Gases in High-Voltage Circuit-Breakers"; Gaseous Dielectric VIII, Edited by Christophorou and Olthoff, Plenum Press, New York, 1998.

* cited by examiner

CIRCUIT BREAKER

FIELD OF THE INVENTION

The present invention relates to a circuit breaker according to the independent claim(s).

BACKGROUND OF THE INVENTION

In conventional high-voltage circuit breakers, the arc formed during a current breaking operation is normally extinguished using sulphur hexafluoride ($SF_6$) as quenching gas. $SF_6$ is known for its high dielectric strength and thermal interruption capability. Pressurized $SF_6$ is also gaseous at the typical minimum operating temperatures of a circuit breaker, non-toxic and non-flammable. Although $SF_6$ might decompose during extinction of the arc, a substantial fraction of the decomposed $SF_6$ recombines, which further contributes to the suitability of $SF_6$ as a quenching gas.

However, $SF_6$ might have some environmental impact when released into the atmosphere, in particular due to its relatively high global warming potential (GWP) and its relatively long lifetime in the atmosphere.

The GWP is a relative measure of how much heat a greenhouse gas traps in the atmosphere. It compares the amount of heat trapped by a certain mass of the gas in question to the amount of heat trapped by a similar mass of carbon dioxide. A GWP is calculated over a specific time interval, commonly 20, 100 or 500 years. It is expressed as a factor of carbon dioxide ($CO_2$), whose GWP is standardized to 1.

So far, the relatively high GWP of $SF_6$ has been coped with by strict gas leakage control and by very careful gas handling. Nevertheless, there is an on-going effort in the development of alternative quenching gases.

One particularly interesting candidate for substituting $SF_6$ as a quenching gas is $CO_2$. $CO_2$ is readily available, non-toxic and non-flammable. As mentioned, $CO_2$ also has a very low GWP of 1. In the amount used for a circuit breaker, it thus has no environmental impact.

In U.S. Pat. No. 7,816,618, e.g., a circuit breaker using $CO_2$ as an arc-extinguishing gas (i.e. quenching gas) for restraining its impact on global warming is described. Furthermore, EP-A-2284854 proposes a mixed gas mainly comprising $CO_2$ and $CH_4$ as an arc-extinguishing medium.

However, according to U.S. Pat. No. 7,816,618, the arc extinction capability of $CO_2$ is inferior to that of $SF_6$. In a circuit breaker of a conventional design, a sufficient interruption performance is thus often not achieved when $CO_2$ is used as a quenching gas. This is particularly the case for relatively high short-current and voltage ratings.

For example, the use of $CO_2$ in a conventional circuit breaker has been described by H. Knobloch, "The comparison of arc-extinguishing capability of sulphur hexafluoride ($SF_6$) with alternative gases in high-voltage circuit breakers", Gaseous Dielectric VIII, Edited by Christophorou and Olthoff, Plenum Press, New York, 1998, and by F. Baberis et al., "Prove di interruzione su interruttori commerciali in gas (MT) con l'utilizzo di miscele SF6-free", CESI Report L17918. According to the former publication, a large reduction in interruption performance resulted from the use of $CO_2$ instead of $SF_6$. According to the latter publication, which is directed to medium voltage applications, a very high $CO_2$ fill pressure of 10 bar (instead of 3.4 bar for $SF_6$) had to be used to achieve the same performance as with $SF_6$, thus rendering the design of the insulators and of the circuit breaker more complex. Increasing the fill-pressure of a high-voltage circuit breaker by a similar factor would require an even more complex and cost-intensive re-design of the high-voltage circuit breaker. Even if a very high fill-pressure of $CO_2$ were provided in a high-voltage circuit breaker, this would not necessarily lead to a dielectric strength equal to the one of a comparable $SF_6$ circuit breaker, since above a certain pressure the dielectric strength of a given gas does no longer increase.

SUMMARY OF THE INVENTION

Considering the drawbacks of the state of the art, the object of the present invention is to provide a circuit breaker of a straightforward design which allows for a very efficient use of the quenching gas. In particular, the circuit breaker shall allow sufficient interruption performance also when a quenching gas having a lower GWP than $SF_6$ is used. Ultimately, the present invention shall thus allow a higher maximum short-circuit current for a non-$SF_6$ circuit breaker, in particular a circuit breaker using $CO_2$.

The problem of the present invention is solved by the circuit breaker according to the independent claim(s). Preferred embodiments are given in the dependent claims.

The present invention thus relates to a circuit breaker comprising:

- at least two contacts movable in relation to each other and defining a quenching region in which an arc is formed during a current breaking operation,
- a pressurization chamber designed such that a quenching gas contained therein is pressurized during a current breaking operation, and
- a nozzle arrangement designed to blow an arc in the quenching region using the quenching gas flowing out from the pressurization chamber.

The nozzle arrangement comprises at least one nozzle defining a nozzle channel or nozzle throat, which during a current breaking operation is connected to the pressurization chamber by a pressurization chamber outflow channel. As will be discussed below, the pressurization chamber outflow channel typically also forms the inflow channel through which gas flows into the pressurization chamber during back-heating (at least in the case where the so-called self-blast effect is present).

The narrowest passage of the pressurization chamber outflow channel to be passed by the outflowing quenching gas defines a pressurization chamber outflow limiting area $A_{pc}$, and the narrowest passage of the nozzle channel to be passed by the outflowing quenching gas defines a nozzle outflow limiting area $A_n$. The smaller area out of the pressurization chamber outflow limiting area $A_{pc}$ and the nozzle outflow limiting area $A_n$, defines an absolute outflow limiting area A.

The circuit breaker of the present invention is now characterized in that the ratio of the pressurization chamber outflow limiting area $A_{pc}$ to the nozzle outflow limiting area $A_n$ is less than 1.1:1.

Preferably, the ratio of the pressurization chamber outflow limiting area $A_{pc}$ to the nozzle outflow limiting area $A_n$ ranges from 0.2:1 to 0.9:1, more preferably from 0.4:1 to 0.8:1.

It has been found that by the specific ratio according to the present invention, the interruption performance of the circuit breaker can be improved.

This finding is most surprising, since conventional designs usually use a higher value for the ratio to avoid the formation of shock-waves in the gas flow present in the pressurization chamber outflow channel, see for example the reference C. M. Franck et al, "Application of High Current and Current Zero Simulations of High-Voltage Circuit Breakers", Contrib. Plasma Phys. 46, No. 10, 787-797 (2006).

The absolute outflow limiting area A may be defined by the nozzle channel or throat or may alternatively be defined by the pressurization chamber outflow channel. In both cases, the respective outflow limiting area designates the smallest passage of the entire available outflow path. Thus, if the nozzle channel comprises two outlets through which the quenching gas can flow out, the nozzle outflow limiting area is equal to the sum of the narrowest passage of the two outlets. In analogy, if the nozzle channel consists of more than one (sub-)channel, the nozzle outflow limiting area $A_n$ is equal to the sum of the narrowest passage of each of the sub-channels. The same applies for the pressurization chamber outflow channel.

The term "channel" as used in the context of the present invention is to be understood broadly including any channel system through which the quenching gas can flow. In particular, it also relates to channels comprising sub-channels and/or branches.

It is understood that the term "quenching gas" in connection with the present application both encompasses a gas of one compound or of a mixture of compounds.

Although it is possible e.g. for medium voltage applications that only one nozzle with one nozzle outlet is provided, the nozzle arrangement comprises in general an insulating nozzle defining an insulating nozzle channel forming a first portion of the nozzle channel, the narrowest passage of the insulating nozzle channel defining an insulating nozzle outflow limiting area $A_{ni}$, and an auxiliary nozzle defining an auxiliary nozzle channel forming a second portion of the nozzle channel and running coaxially to the insulating nozzle channel, the narrowest passage of the auxiliary nozzle channel defining an auxiliary nozzle outflow limiting area $A_{na}$. Thereby, the nozzle outflow limiting area $A_n$ is equal to the sum of $A_{ni}$ and $A_{na}$.

According to one embodiment, the absolute outflow limiting area A is equal to the nozzle outflow limiting area $A_n$. In other words, the narrowest passage of the channel system which is to be passed by the quenching gas is in this embodiment located in the nozzle channel. If the nozzle arrangement comprises an insulating nozzle and an auxiliary nozzle, the absolute outflow limiting area A is in this embodiment equal to the sum of the insulating nozzle outflow limiting area $A_{ni}$ and the auxiliary nozzle outflow limiting area $A_{na}$.

Thus, if the nozzle arrangement comprises an insulating nozzle and an auxiliary nozzle, the mentioned ranges given above (i.e. less than 1.1:1, preferably from 0.2:1 to 0.9:1, more preferably from 0.4:1 to 0.8:1) relate to the ratio of the pressurization chamber outflow limiting area $A_{pc}$ to the sum of the insulating nozzle outflow limiting area $A_{ni}$ and the auxiliary nozzle outflow limiting area $A_{na}$, i.e. $A_n=A_{ni}+A_{na}$.

As mentioned, the narrowest passage of the channel system may alternatively be located in the pressurization chamber outflow channel.

If the absolute outflow limiting area A is located in the pressurization chamber outflow channel, it is preferably located near the opening (also referred to as "heating gap") of the pressurization chamber outflow channel (also referred to as "heating channel") into the nozzle channel or nozzle throat.

In an embodiment, at least the section of the pressurization chamber outflow channel that opens out into the nozzle channel or nozzle throat runs perpendicularly to the direction of the nozzle channel. In another embodiment, at least the section of the pressurization chamber outflow channel that opens out into the nozzle channel runs at an angle different from 90° to the direction of the nozzle channel.

Since the area of the pressurization chamber outflow limiting area does not influence the pressure-reduced thermal interruption performance, a substantial overall improvement of the thermal interruption performance is achieved by this embodiment.

In the case of self-blast circuit breakers, the peak pressure build up will slightly be affected by decreasing the pressurization chamber outflow limiting area from what is experienced in the conventional designs mentioned above. Setting the ratio of the pressurization chamber outflow limiting area $A_{pc}$ to the nozzle outflow limiting area $A_n$ to a value within the above range is particularly advantageous for high-current applications, such as T100a, where higher clearing pressures are not needed and too high peak pressures may damage components of the circuit breaker.

According to a very straightforward and thus preferable embodiment, the pressurization chamber outflow channel is formed by a gap between the insulating nozzle and the auxiliary nozzle.

In general, the nozzle channel has the form of a circular cylinder. Preferably, the narrowest passage of the nozzle channel, i.e. the nozzle outflow limiting area $A_n$, has a circular cross section defined by a radius $r_n$ ranging from 5 mm to 30 mm. It is understood that if the nozzle arrangement comprises an insulating nozzle and an auxiliary nozzle, the above shape and radius refer to the insulating nozzle outflow limiting area $A_{ni}$ and the auxiliary nozzle outflow limiting area $A_{na}$.

The pressurization chamber outflow channel opening with which the pressurization chamber outflow channel opens out into the nozzle channel can both be in the form of multiple holes or can be formed by a circumferential crevice.

Preferably, the edges of the pressurization chamber outflow channel opening are rounded. It is thereby particularly preferred that the curvature of the rounded edges is defined by a radius $r_{hco}$, the ratio from $r_{hco}$ to $r_n$ ranging from 0.1:1 to 2:1, preferably from 0.2:1 to 2:1, more preferably from 0.2:1 to 1:1, even more preferably from 0.4:1 to 1:1, and most preferably from 0.4:1 to 0.8:1.

More preferably, the $r_{hco}$ ranges from about 5 mm to about 10 mm. Thus, an excessive pressure drop in the pressurization chamber outflow channel is avoided, even if the latter is decreased compared to conventional designs mentioned above.

The circuit breaker can both encompass circuit breakers of the puffer-type or the self-blast type or a combination of both types.

According to a particularly preferred embodiment, the pressurization chamber is or comprises a heating space or heating volume, in which the quenching gas is pressurized using the self-blasting or back-heating effect generated by the heat of the arc formed in the quenching region and the ablation of material from the nozzle. In this embodiment, the pressurization chamber outflow channel forms a heating space outflow channel (also referred to as "heating channel") which opens into the nozzle channel or nozzle throat.

Alternatively or additionally, the pressurization chamber can be or can comprise a compression space to which a compression device is attributed, said compression device comprising a piston connected to at least one of the contacts.

The advantages of the present invention are of particular relevance when the circuit breaker is a high-voltage circuit breaker. However, the circuit breaker is not restricted to any voltage ratings and in particular also encompasses medium-voltage circuit breakers. In particular, good arc quenching properties are achieved with lower GWP quenching gases.

According to a particularly preferred embodiment of the present invention, the circuit breaker complies with the following dimensioning equation:

$$V/A=k\cdot c_{sound}(T=300\text{K}),$$

with V being the total volume of the pressurization chamber in cubic meters, A being the absolute outflow limiting area in square meters, $c_{sound}$(T=300K) being the speed of sound in meters per second of the quenching gas at 300 K, and k ranging from 0.005 seconds to 0.025 seconds, whereby the quenching gas has a global warming potential GWP less than the one of $SF_6$ over an interval of 100 years. The quenching gas used according to the present invention thus has a global warming potential of less than 22'800 over an interval of 100 years.

In the dimensioning equation, k represents the outflow time constant of the quenching gas. Thus, it is a measure of the exponential decrease of the pressure in the pressurization chamber with time.

Due to the specific dimensioning equation being complied with, the circuit breaker according to this embodiment provides a sufficient pressure in the pressurization chamber and, thus, a sufficient clearing pressure at current zero, which is decisive for interruption, also when the speed of sound of the quenching gas is relatively high. If the quenching gas is a gas mixture, the relevant speed of sound is that of the gas mixture.

Thus, although a quenching gas having a lower global warming potential than $SF_6$—in particular $CO_2$ or a mixture of $CO_2$ and $O_2$—is used, the circuit breaker still provides sufficient interruption performance.

Particularly, a sufficient clearing pressure at current zero can be achieved, even if a quenching gas having a speed of sound greater than the one of $SF_6$ by a factor of 1.2 or more is used—which is also the case for $CO_2$ or a $CO_2/O_2$ gas mixture. Thus, the problem that a quenching gas having a higher speed of sound theoretically flows out of the pressurization chamber more rapidly (and the required clearing pressure cannot be maintained) is efficiently resolved by the present invention, and in particular by the embodiments complying with the specific dimensioning equation given above.

Complying with the dimensioning equation not only is advantageous with regard to a short-line fault with its high demand on the thermal interruption performance, but also in the case of low terminal faults currents like T10, or out-of-phase current switching, or inductive load switching, which benefit from an increase in the pressure build-up and, ultimately, from an increase in the no-load clearing pressure.

According to a preferred embodiment, the quenching gas comprises at least one gas component selected from the group consisting of $CO_2$, $O_2$, $N_2$, $H_2$, air and a perfluorinated or partially hydrogenated organofluorine compound, and mixtures thereof. Also, the quenching gas can comprise nitrous oxide ($N_2O$) and/or a hydrocarbon, in particular an alkane, more particularly methane ($CH_4$), as well as mixtures thereof with at least one component of the group mentioned above.

It is understood that for the preferred embodiment in which a quenching gas is used having a speed of sound greater than the one of $SF_6$ by a factor of 1.2, also a gas mixture comprising a component having a lower speed of sound can be used, as long as the gas mixture complies with the mentioned requirement, i.e. a speed of sound greater than the one of $SF_6$ by a factor of 1.2.

It is thereby particularly preferred that the quenching gas comprises or essentially consists of $CO_2$ or a mixture of $CO_2$ and $O_2$. As mentioned, $CO_2$ is readily available, non-toxic, non-flammable and has—in the amount used for a circuit breaker—no environmental impact. The same applies for $O_2$.

A mixture of $CO_2$ and $O_2$ is particularly preferred. In this regard it is preferred that the ratio of the molar fraction of $CO_2$ to the molar fraction of $O_2$ ranges from 98:2 to 80:20, since the presence of $O_2$ in the respective amounts allows soot formation to be prevented.

More preferably, the ratio of the molar fraction of $CO_2$ to the molar fraction of $O_2$ ranges from 95:5 to 85:15, even more preferably from 92:8 to 87:13, and most preferably is about 89:11. In this regard, it has been found on the one hand that $O_2$ being present in a molar fraction of at least 5% allows soot formation to be prevented even after repeated current interruption events with high current arcing. On the other hand, $O_2$ being present in a molar fraction of 15% at most reduces the risk of degradation of the circuit breaker's material by oxidation.

If the quenching gas comprises an organofluorine compound, such organofluorine compound can be selected from the group consisting of: a fluorocarbon, a fluoroether, a fluoroamine and a fluoroketone, and preferably is a fluoroketone and/or a fluoroether, more preferably a perfluoroketone and/or a hydrofluoroether, most preferably a perfluoroketone having from 4 to 12 carbon atoms.

Herein, the terms "fluoroether", "fluoroamine" and "fluoroketone" refer to at least partially fluorinated compounds. In particular, the term "fluoroether" encompasses both hydrofluoroethers and perfluoroethers, the term "fluoroamine" encompasses both hydrofluoroamines and perfluoroamines, and the term "fluoroketone" encompasses both hydrofluoroketones and perfluoroketones.

It is thereby preferred that the fluorocarbon, the fluoroether, the fluoroamine and the fluoroketone are fully fluorinated, i.e. perfluorinated. As a rule, the compounds are preferably devoid of any hydrogen which—in particular in view of the potential by-products, such as hydrogen fluoride, generated by decomposition—is generally considered unwanted in circuit breakers.

According to a particularly preferred embodiment, the quenching gas comprises as organofluorine compound a fluoroketone or a mixture of fluoroketones, in particular a fluoromonoketone, and preferably a fluoromonoketone having from 4 to 12 carbon atoms.

Fluoroketones have recently been found to have excellent dielectric insulation properties. They have been found to have also excellent interruption properties.

The term "fluoroketone" as used in the context of the present invention shall be interpreted broadly and shall encompass both perfluoroketones and hydrofluoroketones. The term shall also encompass both saturated compounds and unsaturated compounds including double and/or triple bonds between carbon atoms. The at least partially fluorinated alkyl chain of the fluoroketones can be linear or branched and can optionally form a ring.

The term "fluoroketone" shall encompass compounds that may comprise in-chain hetero-atoms. In exemplary embodiments, the fluoroketone shall have no in-chain hetero-atom.

The term "fluoroketone" shall also encompass fluorodiketones having two carbonyl groups or fluoroketones having more than two carbonyl groups. In exemplary embodiments, the fluoroketone shall be a fluoromonoketone.

According to a preferred embodiment, the fluoroketone is a perfluoroketone. It is preferred that the fluoroketone has a branched alkyl chain. It is also preferred that the fluoroketone is fully saturated.

With regard to the outflow time constant of the quenching gas, k preferably ranges from 0.007 seconds to 0.025 seconds, more preferably from 0.008 seconds to 0.025 seconds, even more preferably from 0.009 seconds to 0.025 seconds, still more preferably from 0.010 seconds to 0.025 seconds, and most preferably is from 0.010 seconds to 0.015 seconds.

According to a further aspect, the present invention thus also relates to a method for adapting an $SF_6$ circuit breaker, which is designed for using $SF_6$ as a quenching gas, to the use of an alternative quenching gas having a global warming potential lower than $SF_6$ over an interval of 100 years, said circuit breaker comprising:

at least two contacts movable in relation to each other and defining a quenching region in which an arc is formed during a current breaking operation, a pressurization chamber designed such that a quenching gas contained therein is pressurized during a current breaking operation, and a nozzle arrangement designed to blow an arc in the quenching region using the quenching gas flowing out from the pressurization chamber, said nozzle arrangement comprising at least one nozzle defining a nozzle channel or throat, which during a current breaking operation is connected to the pressurization chamber by a pressurization chamber outflow channel, the narrowest passage of the pressurization chamber outflow channel to be passed by the outflowing quenching gas defining a pressurization chamber outflow limiting area $A_{pc}$, and the narrowest passage of the nozzle channel to be passed by the outflowing quenching gas defining a nozzle outflow limiting area $A_n$, the smaller area of which defining an absolute outflow limiting area A.

The method is characterized in that it comprises the steps of:

determining the speed of sound $c_{sound}(T=300K)$ of the alternative quenching gas at 300 K;

adapting the total volume V of the pressurization chamber and/or the absolute outflow limiting area A, such that the following dimensioning equation is complied with:

$$V/A=k\cdot c_{sound}(T=300K),$$

with k ranging from 0.005 seconds to 0.025 seconds.

As mentioned, the new design of the circuit breaker according to the present invention is of particular benefit when $CO_2$ is used as a quenching gas, since the speed of sound of $CO_2$ is roughly twice that of $SF_6$, which leads to a more rapid outflow when using $CO_2$ in a $SF_6$ circuit breaker and thus a decrease in the clearing pressure. By adapting the circuit breaker accordingly, the present invention allows for achieving a higher clearing pressure in comparison to conventional designs, as also mentioned.

Due to the lower interruption capability of $CO_2$ in comparison to $SF_6$, the short-circuit current rating as well as the nominal current rating, which typically depends on the short-circuit current rating, is reduced when using $CO_2$ instead of $SF_6$.

When starting from a conventional circuit breaker designed for using $SF_6$ as a quenching gas, the contact diameters and, thus, the diameter of the nozzle channel, which is governed by the contact diameter, can thus be reduced accordingly.

Due to this reduction in the diameter of the nozzle channel, an absolute outflow limiting area A can be achieved which is small enough for a circuit breaker complying with the above dimensioning equation also when $CO_2$ is used. Thus, a significant improvement in the circuit breaker's performance can be achieved with minimal changes to existing circuit breakers that were originally designed for using $SF_6$ as a quenching gas.

When adapting the dimensioning of a conventional circuit breaker in order to comply with the above dimensioning equation, it is preferred that only the absolute outflow limiting area A is adapted, i.e. that A is reduced.

Alternatively or additionally, the volume V of the pressurization chamber might be adapted, i.e. V can be increased.

Besides, all features of embodiments of the circuit breaker as described herein are also favourable in performing the method for adapting an $SF_6$ circuit breaker to an alternative quenching gas as described herein.

BRIEF DESCRIPTION OF THE DRAWINGS

The invention is further illustrated by way of the figures, in which.

DETAILED DESCRIPTION OF THE INVENTION

Figure 1:
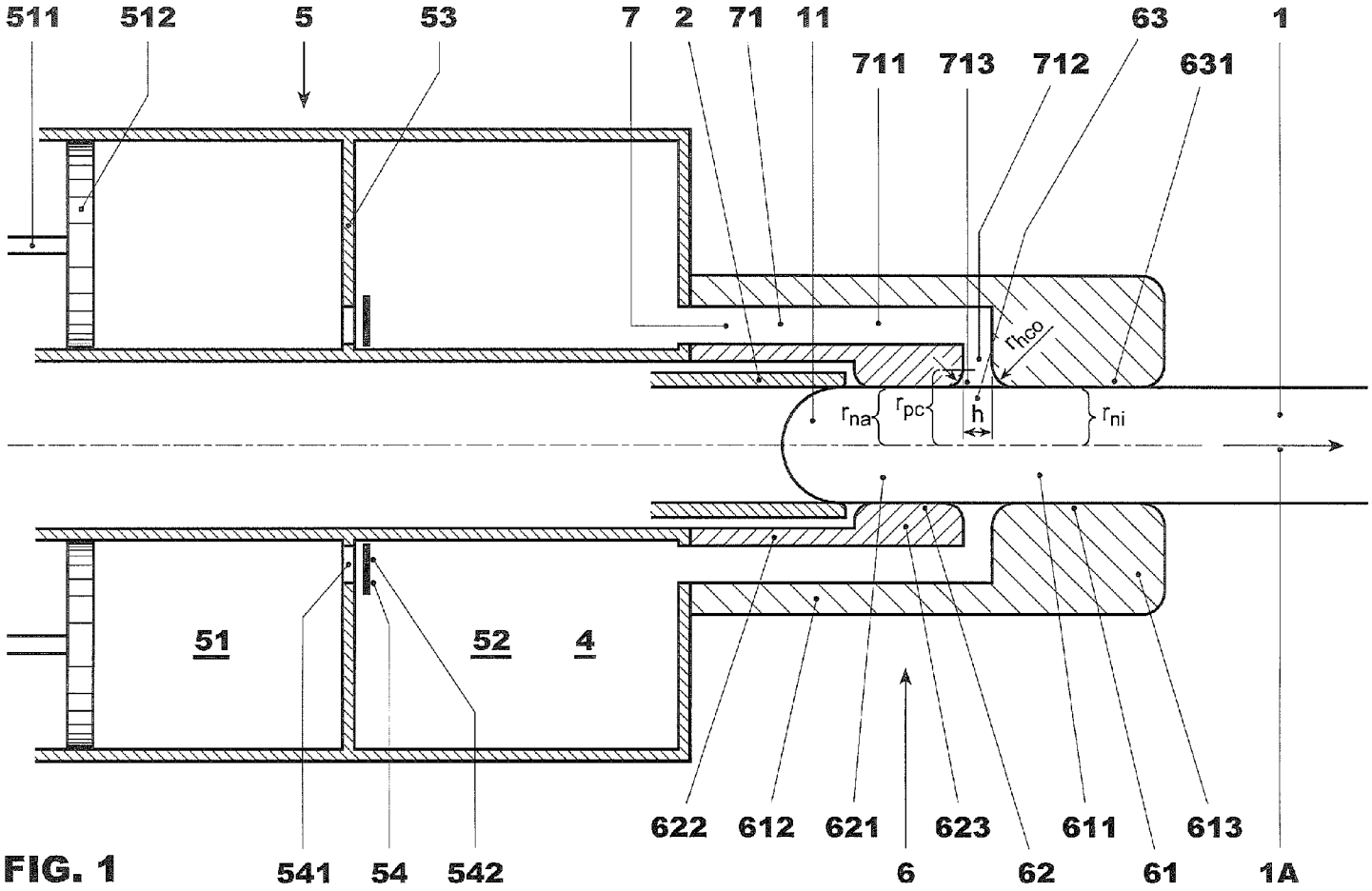
FIG. 1 shows a sectional view on a portion of the circuit breaker of the present invention in a closed position, i.e. prior to a current breaking operation.

The portion of the circuit breaker shown in the figures has cylindrical symmetry. It comprises two contacts movable in relation to each other in an axial direction 1A (the axis shown by a broken line): a first contact in the form of a plug contact 1 and a second contact in the form of a tulip contact 2 engaging around a proximal portion 11 of the plug contact 1 in the closed position shown in FIG. 1. The contacts 1, 2 define a quenching region or arcing zone 3, in which an arc 8 is formed during a current breaking operation, as illustrated in FIG. 2.

In the closed position, the quenching gas 4 is contained in a pressurization chamber 5, which in the embodiment shown comprises a compression space 51 and a heating space 52. To the compression space 51, a compression device 511 is attributed which comprises a piston 512 connected to at least one of the contacts 1, 2 and intended for compressing the quenching gas 4 in the compression space 51. The heating space or heating volume 52 is separated from the compression space 51 by a separating wall 53, but is in communication with the compression space 51 by means of a valve 54 comprising a valve opening 541 and a valve plate 542. Said valve 54 is open in the closed position of the circuit breaker shown in FIG. 1. The valve opening 541 and valve plate 542 can e.g. be both in the form of a single circumferential opening 541 or plate 542, respectively, or in form of a multitude of (sub-)openings or (sub-)plates.

The circuit breaker further comprises a nozzle arrangement 6 for blowing the arc using the quenching gas 4 contained in the pressurization chamber 5. In the embodiment shown, the insulating nozzle arrangement 6 comprises an insulating (main) nozzle 61 and an auxiliary nozzle 62 which are arranged in a radial distance from each other, thereby forming a gap 7. Both the main nozzle 61, herein called insulating nozzle 61, and the auxiliary nozzle 62 are made of an insulating material, such as PTFE.

The insulating nozzle 61 and the auxiliary nozzle 62 are both flanged on the wall of the pressurization chamber 5 enclosing the heating space 52 and both comprise a first cylindrical portion 612, 622, respectively, adjacent to the pressurization chamber 5 and each having a first wall thickness, followed by a second portion 613, 623, respectively, each having a second wall thickness greater than the respective first wall thickness.

The second portion 613 of the insulating nozzle 61 defines an insulating nozzle channel 611 and the second portion 623 of the auxiliary nozzle 62 defines an auxiliary nozzle channel 621, said channels 611, 621 extending co-axially and together forming a nozzle channel 63 having a e.g. circular cross section defined by a radius $r_n$, which essentially corresponds to the cross section of the plug contact 1. Throughout this application, it is understood that the cross sections of the insulating nozzle channel 611 and of the auxiliary nozzle channel 621 can have different radii, as will be discussed further below. Thus, the inner wall 631 of the nozzle channel 63 tightly encloses the plug contact 1 when the circuit breaker is in the closed position, whereby there is always a small gap for mechanical tolerances, e.g. of about 1 mm at least.

By the gap 7, the nozzle channel 63 is in connection with the heating space 52 of the pressurization chamber 5; the gap 7, thus, forms a pressurization chamber outflow channel 71.

The pressurization chamber outflow channel 71 can have two sections: a first section 711, which leads away from the heating space 52 and which is in the form of an annular duct running in axial or predominantly axial direction 1A, and a second section 712, which runs perpendicularly or at least at an angle to the axial direction 1A and thus to the direction of the nozzle channel 63 and runs towards the nozzle channel 63 and opens out into the nozzle channel 63 with a pressurization chamber outflow channel opening 713. The edges of the pressurization chamber outflow channel opening 713 are rounded, the curvature of which being defined by radius $r_{hco}$.

Figure 2:
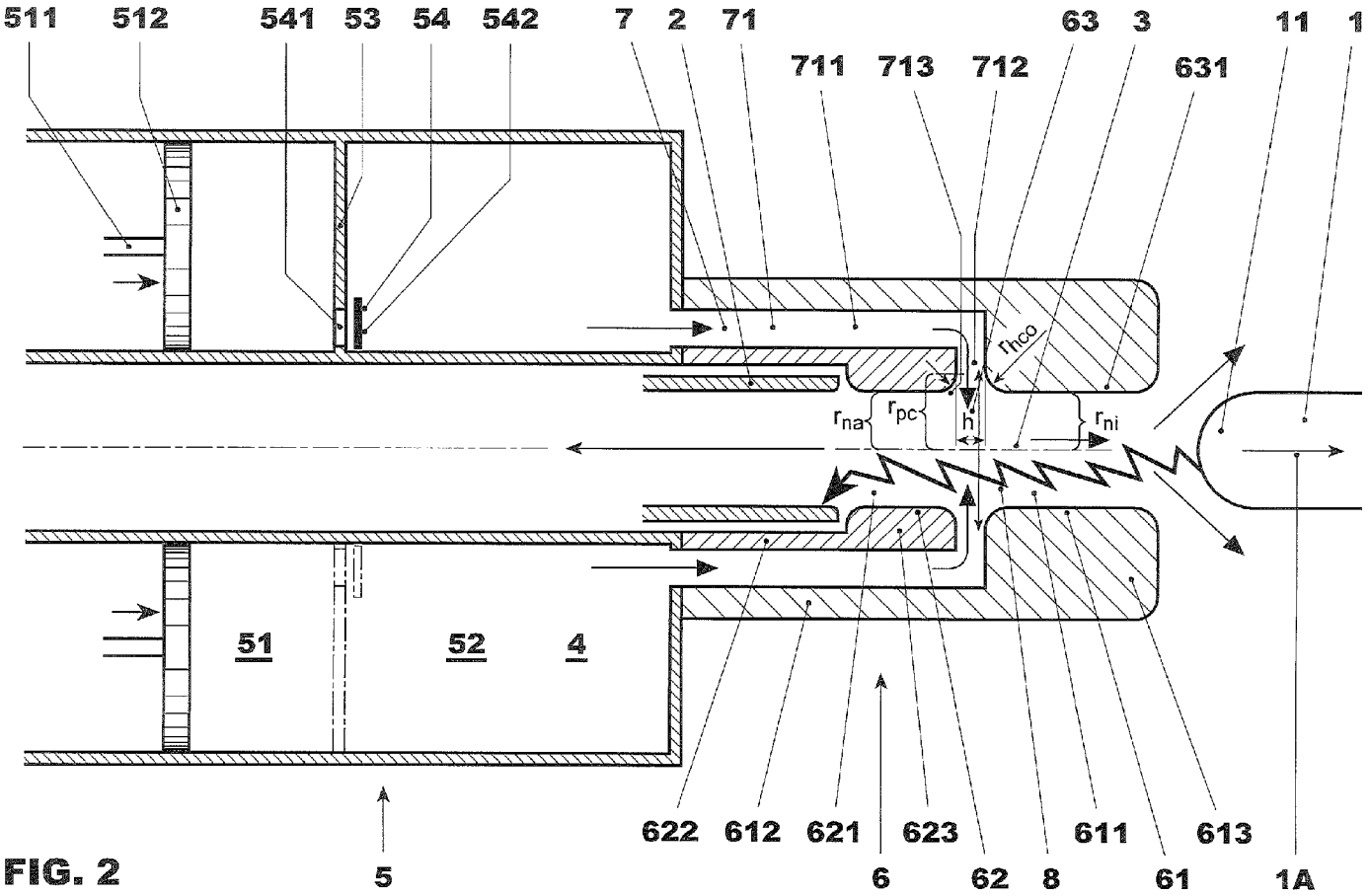
FIG. 2 shows a sectional view on a portion of the circuit breaker according to FIG. 1 during a current breaking operation.

In the closed position of the circuit breaker shown in FIG. 1, the connection between the pressurization chamber outflow channel 71 and the nozzle channel 63 is blocked by the plug contact 1.

During a current breaking operation, the contacts 1, 2 are separated by axial movement relative to each other. Typically, separation is performed by moving the tulip contact 2 while the plug contact 1 remains fixed or, in a "double-move" configuration, can be moved via a gear connected to the tulip contact 2. The compression space 51 and the quenching gas 4 contained therein, respectively, is compressed by the compression device 511 which translates the movement for separating the contacts 1, 2 into a relative movement of the separating wall 53 towards the piston 512.

At the beginning of a breaking operation, the pressure in the compression space 51 is thus increased. Due to this pressure increase, the pressure in the compression space 51 becomes higher than in the heating space 52; the valve 54 is thus maintained in an open state and a flow of quenching gas 4 from the compression space 51 towards the heating space 52 is established.

Once the plug contact 1 is in a position such that the passing of the quenching gas 4 out of the pressurization chamber outflow channel 71 is no longer blocked, the quenching gas 4 flows into the nozzle channel 63, whereby—on the one way—it flows through the insulating nozzle channel 611 towards a first exhaust, and—on the other way and in the opposite direction—through the auxiliary nozzle channel 621 towards a second exhaust, thereby cooling the arc 8. (In the figures, the path of the quenching gas is indicated by arrows.)

Formation of the arc 8 leads to strong ablation of material from the insulating nozzle 61 and the auxiliary nozzle 62, respectively. Due to the heat of the arc and the ablation caused, a gas flow through the pressurization chamber outflow channel 71 towards the heating space 52 is established. Due to this back-heating, the pressure in the heating space 52 increases. When the pressure in the heating space 52 exceeds the pressure in the compression space 51, the valve 54 closes. The heating space 52 then continuously heats up until the pressure in the quenching region 3 is lower than that present in the heating space 52, which occurs when the electric current is decreasing and less material is ablated. Thus, the quenching gas flow is reversed, resulting in a gas flow from the heating space 52 into the nozzle channel 63 and thus into the quenching region 3 (so-called self-blasting effect).

In the open state shown in FIG. 2, the narrowest passage of the nozzle channel 63 to be passed by the outflowing quenching gas 4 defines a nozzle outflow limiting area $A_n$ and the narrowest passage of the pressurization chamber outflow channel 71 to be passed by the outflowing quenching gas 4 defines an pressurization chamber outflow limiting area $A_{pc}$. The smaller value of $A_n$ and $A_{pc}$ defines an absolute outflow limiting area A.

If the narrowest passage of the entire channel system is present in the pressurization chamber outflow channel, i.e. A equals $A_{pc}$, the respective area A can be in the form of a circular ring area (if $A=A_{pc}$ is present in the first section 711 of the pressurization chamber outflow channel 71) or in the form of a mantle area of a cylinder (if $A=A_{pc}$ is present in the second section 712 of the pressurization chamber outflow channel 71).

If present in the nozzle channel 63, the narrowest passage, i.e. the nozzle outflow limiting area $A=A_n$, is defined by the sum of the smallest cross-sectional area of the insulating nozzle channel 611, i.e. the insulating nozzle outflow limiting area $A_{ni}$, and the smallest cross-sectional area of the auxiliary nozzle channel 621, i.e. the auxiliary nozzle outflow limiting area $A_{na}$: $A_n=A_{ni}+A_{na}$.

In the embodiment shown, the absolute outflow limiting area A equals $A_{pc}$, meaning that it is located in the second section 712 of the pressurization chamber outflow channel 71, immediately adjacent to the rounded pressurization chamber outflow channel opening 713. As mentioned, this area A equal to $A_{pc}$ is in the form of a mantle area of a cylinder, which is defined by the distance h (in axial direction) between the insulating nozzle 61 and the auxiliary nozzle 62, i.e. by the width of the gap 7 in the area immediately adjacent to the pressurization chamber outflow channel opening 713, and by the radius $r_{pc}$ of the cylinder by the following equation:

$$A_{pc}=2\pi r_{pch}$$

In other words, $r_{pc}$ is the radius of the axially aligned cylinder, the mantle area of which forms the narrowest outflow area $A_{pc}$ in the pressurization chamber outflow channel 71. The smallest cross-sectional area of the insulating nozzle channel 611 and the auxiliary nozzle channel 621, i.e. the insulating nozzle outflow limiting area $A_{ni}$ and the auxiliary nozzle outflow limiting area $A_{na}$, respectively, is calculated by the following equations, respectively:

$$A_{ni}=\pi r_{ni}^2 \text{ and } A_{na}=\pi r_{na}^2$$

with the $r_{ni}$ and $r_{na}$ being the radius at the smallest cross-sectional area of the insulating nozzle channel 611 and of the auxiliary nozzle channel 621, respectively.

In the embodiment shown in the figures, $r_{ni}$ equals $r_{na}$. However, an insulating nozzle channel 611 and an auxiliary nozzle channel 621 having different radii are also possible; in such an embodiment $r_{ni}$ and $r_{na}$ would be different.

The ratio of the pressurization chamber outflow limiting area $A_{pc}$ to the nozzle outflow limiting area $A_n$, i.e. the total of the insulating nozzle outflow limiting area $A_{ni}$ and the auxiliary nozzle outflow limiting area $A_{na}$, is in the embodiment shown in the figures approximately 1:1 (specifically 0.98:1, when $r_{pc}=r_n+r_{hco}$). The ratio, thus, lies in the range according to the present invention.

Depending on the choice of the alternative quenching gas, the ratio V/A, i.e. the ratio of the total volume of the pressurization chamber (in cubic meters) to the absolute outflow limiting area (in square meters) is preferably such that it complies with the following formula:

$$V/A=k\cdot c_{sound}(T=300\text{K}),$$

with $c_{sound}$(T=300K) being the speed of sound in meters per second of the quenching gas (4) at 300 K, and k ranging from 0.005 seconds to 0.025 seconds.

Given that the size of the contacts is determined by the material they are constructed of and by the amplitude and duration of the short-circuit currents they must sustain, constraints are typically given for the choice of the minimum value of A. Thus, based on the predetermined k-value and the (minimum) value of A, V is suitably chosen.

It is important to note that k does not directly relate to the arcing time, but is related to the physics of the interaction between the arc and the gas flow into and out of the heating volume (in a circuit breaker of the self-blast type) or the compression volume (in a circuit breaker of the puffer-type).

In general, k is chosen such that the gas flow out of, for example, the heating volume is not too fast once flow reverses, since otherwise the pressure will drop rapidly and the flow will be unable to extinguish the arc when current-zero is reached. The flow reverses when the arc current drops from its peak towards the next current-zero crossing. Instead of gas being pumped into the heating volume by the arc, it now flows out into the arc zone, cools and eventually interrupts the arc at current-zero.

Thus, the range given for k does not simply reflect a range of arcing times, i.e. k is not an arcing time constant during a circuit breaker operation. Instead, the values for k result from the complex interaction of the arc with the gas flow and take into account, for example, multiple flow reversals (if the arc is not interrupted during a first current-zero crossing, for example) and other phenomena.

Thus k characterizes the time constant of quenching gas outflow which can start earlier or later than the time window of arcing and can end typically later than the time window of arcing.

A selection of gases suitable for use in the present invention together with their respective speed of sound and GWP is given in Table 1 below.

TABLE 1

| Gas | Speed of sound [m/s] (at 300 K, 0.1 MPa) | Global Warming Potential (100 years) |
|---|---|---|
| $SF_6$ (for comparison) | 135 | 22800 |
| $CO_2$ | 269 | 1 |
| 95% $CO_2$/5% $O_2$ (mole fraction) | 272 | ~1 |
| 90% $CO_2$/10% $O_2$ (mole fraction) | 274 | ~1 |
| 80% $CO_2$/20% $O_2$ (mole fraction) | 279 | ~1 |
| $O_2$ | 330 | <1 |
| $H_2$ | 1319 | <1 |
| $N_2$ | 353 | <1 |
| Air | 347 | <1 |
| $N_2O$ | 268 | 298 |
| $CH_4$ | 450 | 25 |
| $CF_4$ | 181 | 7390 |
| C5-Fluoroketone | liquid at given T, P | ~1 |
| C6-Fluoroketone | liquid at given T, P | ~1 |
| HFE-236fa | no data available | 470 |
| HFE-245cb2/mc | no data available | 708 |

With the exception of the data for "C5-fluoroketone" and "C6-fluoroketone", the standardized GWP data are taken from the IPCC Fourth Assessment Report: Climate Change 2007 (with the only exception of the data for HFE-236fa, which was taken from the WMO's (World Meteorological Organization) "Scientific Assessment of Ozone Depletion: 1998, report number 44 released by the Global Ozone Research and Monitoring Project".

The specific "C5-fluoroketone" as used in the Table 1 relates to the compound 1,1,1,3,4,4,4-heptafluoro-3-(trifluoromethyl)butan-2-one, whereas the specific "C6-fluoroketone" as used in the Table 1 relates to 1,1,1,2,4,4,5,5,5-nonafluoro-2-(trifluoromethyl)pentan-3-one.

"HFE-236fa" relates to the compound 2,2,2-trifluoroethyl-trifluoromethyl ether, whereas "HFE-245cb2/mc" relates to the compound pentafluoro-ethyl-methyl ether.

EXAMPLE

In the following, a method for adapting an $SF_6$ circuit breaker, designed for using $SF_6$ as a quenching gas, to the use of an alternative quenching gas is illustrated by way of a specific example:

As alternative quenching gas, a gas mixture consisting of 90% carbon dioxide and 10% oxygen is provided. This alternative quenching gas has a GWP (over an interval of 100 years) of about 1. The speed of sound $c_{sound}$(T=300K) at 300 K is 274 m/s.

For a preferred value of k ranging from 0.010 to 0.015 s, the total volume V of the pressurization chamber and/or the absolute outflow limiting area A is adapted in a manner such that V/A is in a range from 2.74 to 4.11 m (according to the dimensioning equation $V/A=k\cdot c_{sound}$(T=300K) with k ranging from 0.010 seconds to 0.015 seconds). In an embodiment, V/A is adapted to about 3.4 m.

Given the required contact diameter and the required gap around the contacts to prevent the contact from touching the nozzle during an opening or closing operation, radius r at the smallest cross-sectional area of both the insulating (main) nozzle channel and the auxiliary nozzle channel can be assumed to be 0.01 m. Accordingly, the absolute outflow limiting area ($A=2\pi r^2$) is thus 0.00063 $m^2$. Then, the total volume V of the pressurization chamber is adapted according to the following equation:

$$V=(3.4\text{ m})\cdot(0.00063\text{ m}^2)=0.002\text{ m}^3$$

In contrast thereto, the use of $SF_6$ (having a $c_{sound}$ (T=300K) of about 135 m/s) in the adapted circuit breaker leads to k-values ranging from 0.020 seconds to 0.030 seconds (i.e. outside of the preferred range of 0.010 seconds to 0.015 seconds).

As mentioned above, in embodiments the outflow time constant k of the quenching gas during a circuit breaker operation preferably ranges from 0.007 seconds to 0.025 seconds, more preferably from 0.008 seconds to 0.025 seconds, even more preferably from 0.009 seconds to 0.025 seconds, still more preferably from 0.010 seconds to 0.025 seconds, and most preferably is from 0.010 seconds to 0.015 seconds.

A lower value of the outflow time constant k can be chosen in embodiments, in which the arcing time is limited to a small range of values, e.g. in embodiments in which short-circuit monitoring and/or circuit breaker trip systems are used.

In an embodiment, arcing times in the range of 1 millisecond to 2 milliseconds can occur when performing synchronized switching. In these embodiments, k can be adjusted by modifying V/A to provide optimal interruption of the arc for such short arcing times. Specifically, for a defined arcing time in the range of 1 to 2 milliseconds, the outflow time constant k is appropriately set to 0.005 seconds, the dimensioning equation resulting for $CO_2$ in a ratio V/A of 1.4 m. This ratio is clearly different to the respective ratio V/A for $SF_6$, which ratio is about 0.7 m.

The pressure build-up in a synchronized switching embodiment can be provided by a puffer mechanism, since there is neither sufficient time nor arc energy for the arc to build up the required pressure on its own.

LIST OF REFERENCE NUMERALS

1 plug contact
1A axial direction
11 proximal portion (of plug contact 1)
2 tulip contact
3 quenching region, arcing zone
4 quenching gas
5 pressurization chamber
51 compression space
511 compression device
512 piston
52 heating space, heating volume
53 separating wall
54 valve
541 valve opening
542 valve plate
6 insulating nozzle arrangement
61 insulating nozzle, main nozzle
611 insulating nozzle channel
612 first portion of insulating nozzle
613 second portion of insulating nozzle
62 auxiliary nozzle
621 auxiliary nozzle channel
622 first portion of auxiliary nozzle
623 second portion of auxiliary nozzle
63 nozzle channel
631 inner wall of nozzle channel
7 gap
71 pressurization chamber outflow channel
711 first section of pressurization chamber outflow channel
712 second section of pressurization chamber outflow channel
713 pressurization chamber outflow channel opening
8 arc

LIST OF SYMBOLS

A absolute outflow limiting area (in square meters)
$A_n$ nozzle outflow limiting area
$A_{na}$ auxiliary nozzle outflow limiting area
$A_{ni}$ insulating (main) nozzle outflow limiting area
$A_{pc}$ pressurization chamber outflow limiting area
$c_{sound}$(T=300K) speed of sound in meters per second of the quenching gas at 300 K
h (axial) distance between insulating nozzle and auxiliary nozzle
k outflow time constant of the quenching gas
$r_{hco}$ radius defining the curvature of the rounded edges of the pressurization chamber outflow channel opening
$r_n$ radius of the nozzle channel
$r_{ni}$ radius at the smallest cross-sectional area of the insulating (main) nozzle channel
$r_{na}$ radius at the smallest cross-sectional area of the auxiliary nozzle channel
$r_{pc}$ radius of the cylinder, the mantle area of which forms the narrowest passage in the pressurization chamber outflow channel
V total volume of the pressurization chamber (in cubic meters)

What is claimed is:

1. A circuit breaker, comprising:

at least two contacts movable in relation to each other and defining a quenching region in which an arc is formed during a current breaking operation, a pressurization chamber designed such that a quenching gas contained therein is pressurized during a current breaking operation, and a nozzle arrangement designed to blow an arc in the quenching region using the quenching gas flowing out from the pressurization chamber, said nozzle arrangement comprising at least one nozzle defining a nozzle channel, which during a current breaking operation is connected to the pressurization chamber by a pressurization chamber outflow channel, a narrowest passage of the pressurization chamber outflow channel to be passed by the outflowing quenching gas defining a pressurization chamber outflow limiting area $A_{pc}$, and the narrowest passage of the nozzle channel to be passed by the outflowing quenching gas defining a nozzle outflow limiting area $A_n$, the smaller area of which defining an absolute outflow limiting area A, the quenching gas having a global warming potential lower than the global warming potential of sulphur hexafluoride over an interval of 100 years, wherein a ratio of the pressurization chamber outflow limiting area $A_{pc}$ to the nozzle outflow limiting area $A_n$ is less than 1.1:1.

2. The circuit breaker according to claim 1, wherein the ratio of the pressurization chamber outflow limiting area $A_{pc}$ to the nozzle outflow limiting area $A_n$ ranges from 0.2:1 to 0.9:1.

3. The circuit breaker according to claim 1, wherein the nozzle arrangement comprises an insulating nozzle defining an insulating nozzle channel forming a first portion of the nozzle channel, the narrowest passage of the insulating nozzle channel defining an insulating nozzle outflow limiting area $A_{ni}$, and an auxiliary nozzle defining an auxiliary nozzle channel forming a second portion of the nozzle channel and running coaxially to the insulating nozzle channel, the narrowest passage of the auxiliary nozzle channel defining an auxiliary nozzle outflow limiting area $A_{na}$, the nozzle outflow limiting area $A_n$ being equal to the sum of the insulating nozzle outflow limiting area $A_{ni}$ and the auxiliary nozzle outflow limiting area $A_{na}$.

4. The circuit breaker according to claim 3, the absolute outflow limiting area A being equal to the nozzle outflow limiting area $A_n$.

5. The circuit breaker according to claim 1, wherein at least a section of the pressurization chamber outflow channel that opens out into the nozzle channel runs perpendicularly or at an angle different from 90° to the direction of the nozzle channel.

6. The circuit breaker according to claim 1, wherein the pressurization chamber outflow channel is formed by a gap between the insulating nozzle and the auxiliary nozzle.

7. The circuit breaker according to claim 1, wherein the nozzle outflow limiting area $A_n$ has a circular cross section defined by a radius $r_n$, with the radius $r_n$ ranging from 5 mm to 30 mm.

8. The circuit breaker according claim 1, wherein the pressurization chamber outflow channel opens out into the nozzle channel by a pressurization chamber outflow channel opening, the edges of which are rounded.

9. The circuit breaker according to claim 8, wherein the nozzle outflow limiting area $A_n$ has a circular cross section defined by a radius $r_n$, the curvature of the rounded edges of the pressurization chamber outflow channel opening is defined by a radius $r_{hco}$, and the ratio of the radius $r_{hco}$ to the radius $r_n$ ranges from 0.1:1 to 2:1.

10. The circuit breaker according to claim 1, wherein the pressurization chamber is or comprises a heating space, wherein the quenching gas is pressurized using the back-heating effect generated by the heat of the arc formed in the quenching region and the ablation of material from the nozzle arrangement.

11. The circuit breaker according to claim 1, wherein the pressurization chamber comprises a compression space to which a compression device is attributed, said compression device comprising a piston connected to at least one of the contacts.

12. The circuit breaker according to claim 1, wherein the circuit breaker is a high-voltage circuit breaker.

13. The circuit breaker according to claim 1, wherein the circuit breaker complies with the following dimensioning equation:

$$V/A=k\cdot c_{sound}(T=300\text{K}),$$

with V being the total volume of the pressurization chamber in cubic meters,

A being the absolute outflow limiting area in square meters, $c_{sound}$(T=300K) being the speed of sound in meters per second of the quenching gas at 300 K, and k ranging from 0.005 seconds to 0.025 seconds.

14. The circuit breaker according to claim 1, wherein the speed of sound of the quenching gas at 300 K is greater than the one of sulphur hexafluoride at 300 K by a factor of at least 1.2.

15. The circuit breaker according to claim 1, wherein the quenching gas comprises at least one gas component selected from the group consisting of $CO_2$, $O_2$, $N_2$, $H_2$, air, $N_2O$, a hydrocarbon, in particular $CH_4$, a perfluorinated or partially hydrogenated organofluorine compound, and mixtures thereof.

16. The circuit breaker according to claim 1, wherein the quenching gas comprises $CO_2$ or a mixture of $CO_2$ and $O_2$.

17. The circuit breaker according to claim 15, wherein the organofluorine compound is selected from the group consisting of a fluorocarbon, a fluoroether, a fluoroamine and a fluoroketone.

18. The circuit breaker according to any of the claims 13 to 17, wherein k is an outflow time constant of the quenching gas during a circuit breaker operation; and/or that k is not an arcing time constant during a circuit breaker operation; and/or that k ranges from 0.007 seconds to 0.025 seconds.

19. The circuit breaker according to claim 1, wherein the ratio of the pressurization chamber outflow limiting area $A_{pc}$ to the nozzle outflow limiting area $A_n$ ranges from 0.4:1 to 0.8:1.

20. The circuit breaker according to claim 9, the ratio of the radius $r_{hco}$ to the radius $r_n$ ranges from 0.2:1 to 2:1.

21. The circuit breaker according to claim 9, the ratio of the radius $r_{hco}$ to the radius $r_n$ ranges from 0.2:1 to 1:1.

22. The circuit breaker according to claim 9, the ratio of the radius $r_{hco}$ to the radius $r_n$ ranges from 0.4:1 to 1:1.

23. The circuit breaker according to claim 9, the ratio of the radius $r_{hco}$ to the radius $r_n$ ranges from 0.4:1 to 0.8:1.

24. The circuit breaker according to claim 15, wherein the organofluorine compound is a fluoroketone and/or a fluoroether.

25. The circuit breaker according to claim 15, wherein the organofluorine compound is a perfluoroketone and/or a hydrofluoroether.

26. The circuit breaker according to claim 15, wherein the organofluorine compound is a perfluoroketone having from 4 to 12 carbon atoms.

27. The circuit breaker according to claim 13, wherein k ranges from 0.008 seconds to 0.025 seconds.

28. The circuit breaker according to claim 13, wherein k ranges from 0.009 seconds to 0.025 seconds.

29. The circuit breaker according to claim 13, wherein k ranges from 0.010 seconds to 0.025 seconds.

30. The circuit breaker according to claim 13, wherein k ranges from 0.010 seconds to 0.015 seconds.

* * * * *